US012790974B2

(12) United States Patent
Lulla et al.

(10) Patent No.: US 12,790,974 B2
(45) Date of Patent: Nov. 10, 2026

(54) SYSTEM, METHOD, AND APPARATUS FOR CONTROLLING FLUID FLOW FROM PISTON COOLING NOZZLES

(71) Applicant: Cummins Inc., Columbus, IN (US)

(72) Inventors: Nikhil O. Lulla, Columbus, IN (US); Roopak Manoharrao Ingole, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/911,410

(22) Filed: Oct. 10, 2024

(65) Prior Publication Data

US 2025/0137398 A1 May 1, 2025

Related U.S. Application Data

(60) Provisional application No. 63/593,697, filed on Oct. 27, 2023.

(51) Int. Cl.

| | |
|---|---|
| ***F01P 3/06*** | (2006.01) |
| ***F01P 7/14*** | (2006.01) |
| *F01P 3/00* | (2006.01) |

(52) U.S. Cl.

CPC ..... *F01P 3/06* (2013.01); *F01P 7/14* (2013.01); *F01P 2003/006* (2013.01); *F01P 2007/146* (2013.01); *F01P 2025/04* (2013.01); *F01P 2025/42* (2013.01); *F01P 2025/64* (2013.01)

(58) Field of Classification Search

CPC ..... F01P 3/06; F01P 7/14; F01P 2003/006; F01P 2007/146; F01P 2025/04; F01P 2025/42; F01P 2025/64

See application file for complete search history.

(56) References Cited

U.S. PATENT DOCUMENTS

| | | | |
|---|---|---|---|
| 5,819,692 | A | 10/1998 | Schafer |
| 8,977,477 | B2 | 3/2015 | Maki et al. |
| 9,644,506 | B2 | 5/2017 | Bidner et al. |
| 9,670,802 | B2 | 6/2017 | Maki et al. |
| 11,047,290 | B2 | 6/2021 | Heald |
| 11,467,062 | B2 | 10/2022 | Han et al. |
| 11,649,757 | B2 | 5/2023 | Dods et al. |
| 2005/0120982 | A1 | 6/2005 | Ducu |
| 2007/0221149 | A1 | 9/2007 | Ruiz |
| 2011/0276249 | A1 | 11/2011 | Argolini et al. |

(Continued)

FOREIGN PATENT DOCUMENTS

| | | | |
|---|---|---|---|
| CN | 105649747 | A | 8/2018 |
| CN | 111750257 | A | 5/2021 |

(Continued)

OTHER PUBLICATIONS

Extended European Search Report, EP Application No. 24206383.2, Dated Mar. 14, 2025, 8 pgs.

*Primary Examiner* — Syed O Hasan

(74) *Attorney, Agent, or Firm* — Taft, Stettinius & Hollister LLP

(57) ABSTRACT

Systems, methods, and apparatuses are disclosed for controlling fluid flow to piston cooling nozzles with a fluid flow control device. The fluid flow control device includes a valve that is electronically controlled to open or close a piston cooling nozzle rifle to one or more piston cooling nozzles based on one or more engine operating parameters.

20 Claims, 7 Drawing Sheets

(56) References Cited

U.S. PATENT DOCUMENTS

| | | | | |
|---|---|---|---|---|
| 2011/0283968 | A1* | 11/2011 | Anderson | F01M 1/08 123/196 R |
| 2013/0206083 | A1* | 8/2013 | Wood | F01M 1/08 123/495 |
| 2015/0292390 | A1 | 10/2015 | Takasaki et al. | |
| 2018/0058277 | A1* | 3/2018 | Demots | F01M 1/16 |
| 2018/0363537 | A1* | 12/2018 | Mark | F01P 3/08 |
| 2021/0108553 | A1 | 4/2021 | Lee et al. | |

FOREIGN PATENT DOCUMENTS

| | | | |
|---|---|---|---|
| GB | 2428452 | A | 1/2007 |
| GB | 2484748 | A | 4/2012 |
| JP | 2003097269 | A | 4/2003 |

* cited by examiner

SYSTEM, METHOD, AND APPARATUS FOR CONTROLLING FLUID FLOW FROM PISTON COOLING NOZZLES

CROSS-REFERENCE TO RELATED APPLICATION

The present application claims priority to, and the benefit of the filing date of, U.S. Provisional App. Ser. No. 63/593,697 filed on Oct. 27, 2023, which is incorporated herein by reference in its entirety for all purposes.

FIELD OF THE DISCLOSURE

The present disclosure relates generally to internal combustion engines, and more particularly, but not exclusively, to controlling fluid flow from piston cooling nozzles.

BACKGROUND

Generally, fluid flow control devices have been used in internal combustion engines to control the flow of oil and other cooling fluids to provide cooling of one or more components of the engine. For example, piston cooling nozzles can be supplied with cooling fluid to be sprayed onto the underside of the piston to provide cooling at higher engine speeds. Piston cooling nozzles can be passively controlled so that, when the engine speed drops below a threshold speed, the supply of cooling fluid from the piston cooling nozzles is stopped.

However, passive control of fluid flow from piston cooling nozzles may divert cooling fluid to the pistons during operating conditions in which piston cooling is not needed or desired, resulting in increased oil consumption, increased pumping losses, and/or delayed engine warm-up during cold start conditions. In addition, cooling fluid may be diverted for piston cooling during conditions in which the cooling fluid can be directed for higher priority usage, such as for cam phaser control. As such, there exists a need for improvement in fluid flow control devices for cooling of pistons in an internal combustion engine.

SUMMARY

The present disclosure includes a unique system, method, and/or apparatus for cooling pistons in an internal combustion engine. The piston cooling system includes a reservoir from which fluid is fed and at least one piston cooling nozzle coupled to the reservoir and configured to direct the fluid fed from the reservoir for spraying the fluid onto a piston in the engine. The piston cooling system includes a fluid flow control device that connects the reservoir and the at least one piston cooling nozzle. The fluid flow control device is actively controlled in response to one or more engine operating conditions to selectively provide fluid from the at least one piston cooling nozzle for piston cooling and shut off the fluid from the at least one piston cooling nozzle when piston cooling is not needed and/or when there is a higher priority usage for the fluid.

In one embodiment, the fluid flow control device includes a chamber that connects the main rifle in the engine block with the piston cooling nozzle rifle in the engine block. The fluid flow control device includes an electronically controllable valve in the chamber that is operable to selectively open and close (shut off) the chamber connecting the main rifle and the piston cooling nozzle rifle in response to one or more engine operating conditions. The valve of the fluid flow control device is opened to allow the fluid to pass from the main rifle to the piston cooling nozzle rifle through the chamber. The valve of the fluid flow control device is closed to prevent fluid from flowing through the chamber from the main rifle to the piston cooling nozzle rifle.

Another embodiment includes a method and/or apparatus for controlling fluid flow through at least one piston cooling nozzle device used for cooling pistons in an internal combustion engine. The method and/or apparatus is configured to selectively open and close the at least one piston cooling nozzle device in response to one or more engine operating conditions. In an embodiment, the piston cooling nozzle device is an electronically controllable valve that is controlled to open and close in response to commands from an engine control unit.

This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The description herein makes reference to the accompanying drawings wherein like numerals refer to like parts throughout the several views, and wherein.

DETAILED DESCRIPTION OF ILLUSTRATIVE EMBODIMENTS

For the purposes of clearly, concisely and exactly describing illustrative embodiments of the present disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

Figure 1:
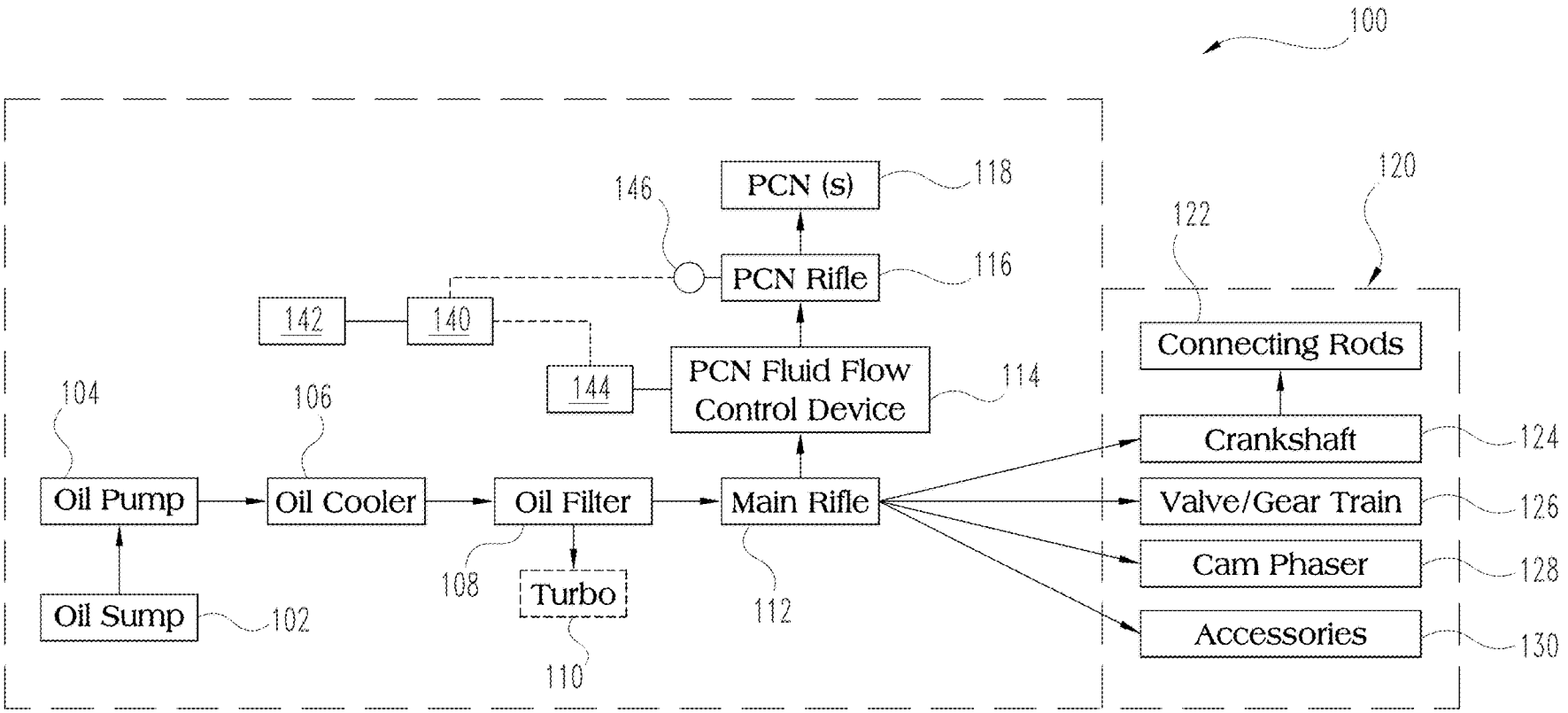
FIG. 1 is a schematic block diagram of an example engine lubrication system having a fluid flow control device to control fluid flow to one or more piston cooling nozzles, according to an embodiment of the present disclosure.

Referring to FIG. 1, a schematic block diagram of an example engine lubrication system 100 for an engine 120 is shown. The system 100 may include a sump 102 that contains fluid, such as engine oil or other fluid for lubricating and/or cooling the engine 120. The system 100 may also include a pump 104 to extract fluid from the sump 102 before the fluid is cooled by a cooler 106, which may generally be used to remove surplus heat from the engine 120 to use the fluid as a coolant. After the fluid is cooled, the fluid may be filtered in a filter 108 to remove any contaminants from the fluid. As shown in FIG. 1, the system 100 may optionally include a turbocharger 110.

The system 100 may further include a main fluid supply rifle 112 that is supplied fluid from the pump 104. Main fluid supply rifle 112 is coupled to a piston cooling nozzle rifle 116 with a fluid flow control device 114. Fluid flow control device 114 is controllable to selectively provide the fluid to be sprayed via one or more piston cooling nozzles (PCN) 118 onto one or more pistons of the engine 120.

In an example embodiment, the piston cooling nozzle fluid flow control device 114 is operable to selectively control the fluid flowing from the main fluid supply rifle 112 into one or more piston cooling nozzle rifles 116. The one or more piston cooling nozzle rifles 116 are connected to one or more PCNs 118 that are configured to direct fluid spray toward one or more pistons. It should be appreciated that fluid also can be supplied from main fluid supply rifle 112 to various other components of the internal combustion engine as shown in FIG. 1 such as, for example, connecting rods 122, crankshaft 124, valve/gear trains 126, cam phaser(s) 128, and other accessories 130 (not listed).

System 100 includes an electronic control unit (ECU) 140 operably connected fluid flow control device 114 to selectively control fluid flow to PCN rifle 116 in response to engine operating conditions, as discussed further below. In an embodiment, ECU 140 is operable to provide actuation commands to an actuator 144 of fluid flow control device 114 to selectively open fluid flow control device 114 to provide fluid flow to PCN rifle 116 or close fluid flow control device 114 to stop fluid flow to PCN rifle 116. ECU 140 is also in operative communication with and configured to receive engine operating parameters from one or more engine sensors 142 and a pressure sensor 146 of PCN rifle 116.

ECU 140 is an example of a component of an electronic control system (ECS) configured and operable to execute operating logic that defines various control, diagnostic, management, and/or regulation functions. For example, the non-transitory memory medium may be configured with instructions executable by the processor to perform a number of acts, evaluations, or operations including those described herein. The operating logic of ECU 140 or other ECS components may be in the form of dedicated hardware, such as a hardwired state machine, analog calculating machine, programming instructions, and/or a different form as would occur to those skilled in the art.

While ECU 140 is depicted as single unit in the illustrated example, it shall be appreciated that one or more processors, one or more non-transitory memory medium, and related components may be provided as or distributed across or among multiple units or physical packages. For example, one or more processors, such as programmable microprocessors or microcontrollers of a solid-state, integrated circuit type may be provided in one or more control units and can be implemented in any of a number of ways that combine or distribute the control function across one or more control units in various manners. Other components or subsystems of ECU 140 and/or its associated ECS may also be so configured or provided.

Figure 2:
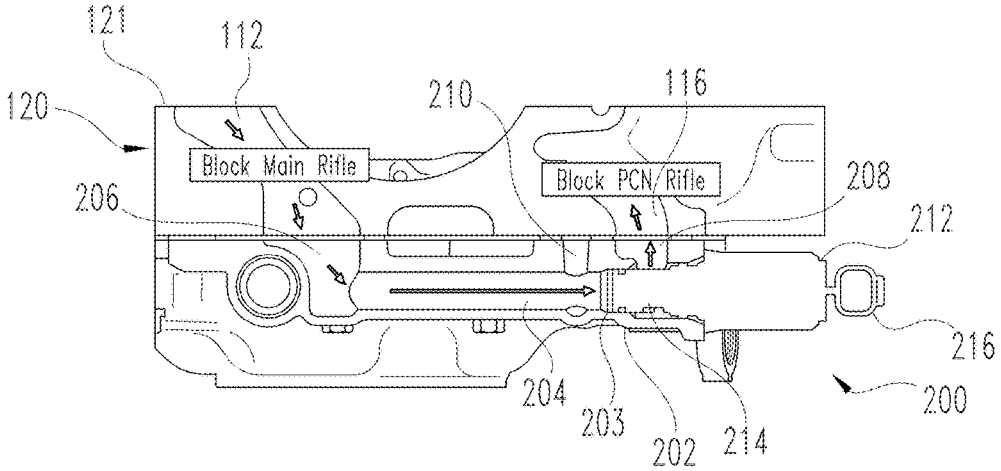
FIG. 2 is a section view of an embodiment of the fluid flow control device of FIG. 1 in a closed position.
Figure 3:
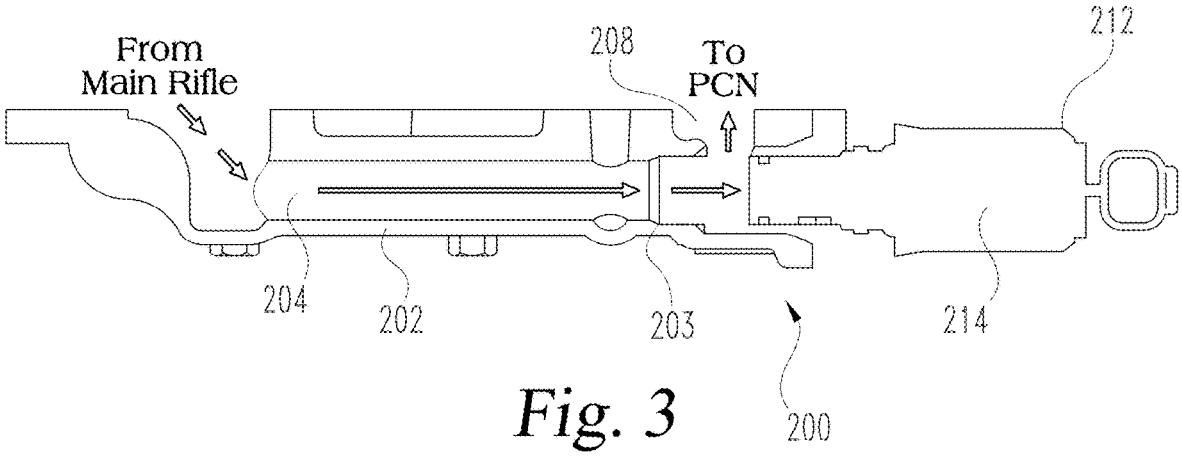
FIG. 3 is a section view of the fluid flow control device of FIG. 2 in an open position.

Referring to FIGS. 2-3, an embodiment of the fluid flow control device 114 is shown and designated at 200. Fluid flow control device 200 may be coupled to block 121 of engine 120 to provide a flow path from main fluid supply rifle 112 to PCN rifle 116. Fluid flow control device 200 includes a housing 202 that defines a chamber 204. Chamber 204 includes an inlet 206 defined by housing 202 in fluid communication with main fluid supply rifle 112. Chamber 204 includes an outlet 208 defined by housing 202 in fluid communication with PCN rifle 116. Housing 202 may also include a relief outlet 210 that is connected to a pressure relief valve (not shown.)

Fluid flow control device 200 also includes a valve 212 operably connected to actuator 144, such as an electronic actuator 216 shown in FIG. 2. In an embodiment, electronic actuator 216 is a solenoid that is actuatable to move valve 112 between an open position and a closed position in response to PCN ON and OFF commands, respectively, from ECU 140.

In an example embodiment, the valve 212 of fluid flow control device 200 includes a plunger 214 that is housed in chamber 204 of housing 202. The valve 212 is selectively and electronically controlled to axially move plunger 214 to open and closed positions to open and close outlet 208 of chamber 204. In the closed position of FIG. 2, plunger 214 sealing engages a seat 203 in housing 202, and fluid flow is not able to flow from chamber 204 through outlet 208 to PCN rifle 116, and the PCN(s) 118 is OFF. In the open position, plunger 214 is disengaged from the seat 203, and fluid is able to flow from chamber 204 through outlet 208 to PCN rifle 116, and the PCN(s) 118 is ON and spraying fluid for cooling one or more pistons.

Other embodiments contemplate other locations for valve 212, such as near inlet 204 or at other positions within chamber 204. The fluid flow control device 200 may include a one-way fluid flow control device such as a check valve to allow fluid (e.g., oil) to flow only or primarily in one direction through chamber 204. Housing 202 may include one or more flanges, holes, and other structure to permit mounting of fluid flow control device 200 on or near engine 120.

According to an aspect of the present disclosure, the fluid flow control device 114, including the fluid flow control device 200 or other embodiment, may be actively controlled to open and close PCN rifle 116 in response to one or more engine operating parameters. The schematic flow descriptions which follow provide an illustrative embodiment of performing procedures for controlling fluid flow control device 114 between the open and closed positions. Operations illustrated are understood to be exemplary only, and operations may be combined or divided, and added or removed, as well as re-ordered in whole or part, unless stated explicitly to the contrary herein. Certain operations illustrated may be implemented by a computer, such as ECU 140, executing a computer program product on a non-transitory computer readable medium, where the computer program product comprises instructions causing the computer to execute one or more of the operations, or to issue commands to other devices to execute one or more of the operations.

Figure 4:
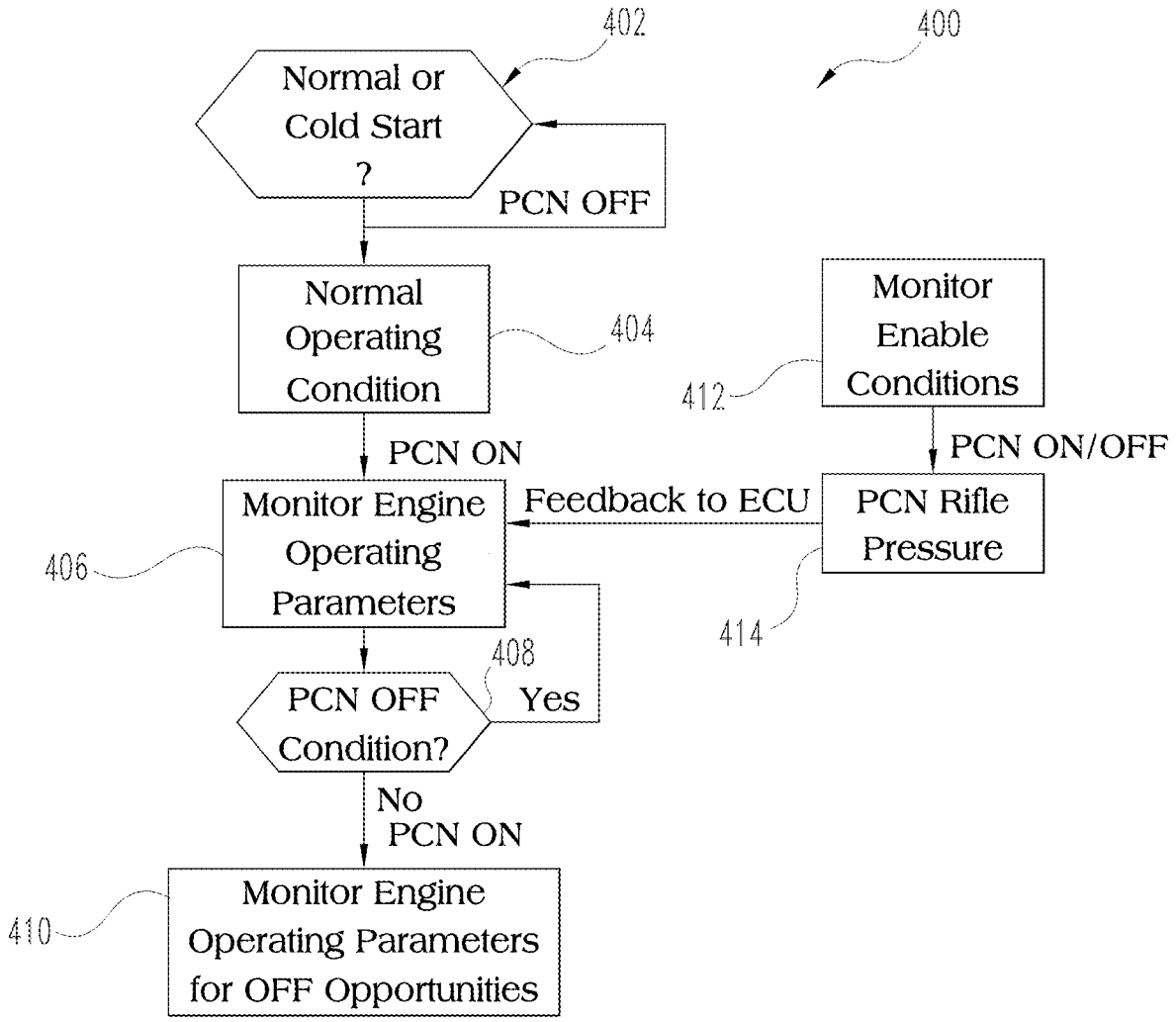
FIG. 4 is a flow diagram of a procedure for controlling fluid flow to a piston cooling nozzle according to an embodiment of the present disclosure.

Referring to FIG. 4, a flow diagram of an embodiment of a procedure 400 for controlling fluid flow control device 114 is shown. Procedure 400 starts at conditional 402 to determine if the engine is operating under a cold start condition or a normal condition in which engine operating temperature (s) are at or above a cold start condition threshold. Under cold start conditions, the PCN rifle 116 is closed so the PCN(s) 118 are OFF to allow engine temperature to increase without directing cooling fluid to the pistons. Once normal operating temperature conditions are achieved at operation 404, the PCN rifle is opened so the PCN(s) 118 are defaulted to ON to ensure cooling fluid is normally supplied to the pistons.

At operation 412, operating conditions of engine 120 are monitored to determine if active ON/OFF control of PCN(s) 118 is enabled. Operation 412 includes determining engine conditions are suitable for entering the algorithm or procedure for PCN ON/OFF control. The monitored engine operating conditions include, for example, an engine state, oil temperature, oil pressure, coolant temperature, and intake manifold temperature (IMT). All or some of these engine operating conditions can be used to determine if active ON/OFF control of the PCN(s) 118 is enabled. In an embodiment, the enable conditions include the engine state as running, the oil temperature being greater than a low oil temperature threshold, the IMT being greater than a low IMT threshold, the oil pressure being greater than a low oil pressure threshold and less than a high oil pressure threshold, and the coolant temperature being greater than a low coolant temperature threshold and less than a high coolant temperature threshold.

These engine operating conditions for turning PCN(s) 118 ON/OFF are also provided as feedback to an operation 406 for monitoring one or more engine operating parameters to control fluid flow control device 114 to the open position or the closed position. The PCN rifle pressure is also determined at operation 414 and provided as feedback to operation 406 to allow error detection of the PCN actuator 144.

Procedure 400 continues at conditional 408 to determine if engine operating parameters indicate that a PCN OFF condition is present. In an embodiment, a PCN OFF condition is an engine speed operating parameter being below a low engine speed threshold and an engine torque operating parameter being below a low engine torque threshold. If conditional 408 is YES, the PCN(s) 118 is turned OFF by closing PCN rifle 116 with fluid flow control device 114. Procedure 400 returns to operation 406 to monitor engine operating conditions for ON/OFF control of PCN(s) 118 and enable conditions that allow PCN ON/OFF control.

If conditional 408 is NO, the PCN(s) 118 is ON and fluid flow control device 114 is moved to open PCN rifle 116. Procedure 400 continues at operation 410 to monitor engine operating parameters for opportunities to turn PCN(s) 118 OFF. For example, as discussed further below, some engine operating parameters provide a zone of operation that, while not permitting PCN(s) 118 to remain OFF continuously or ON continuously, permit time-based, intermittent ON and OFF operation of PCN(s) 118.

Figure 5:
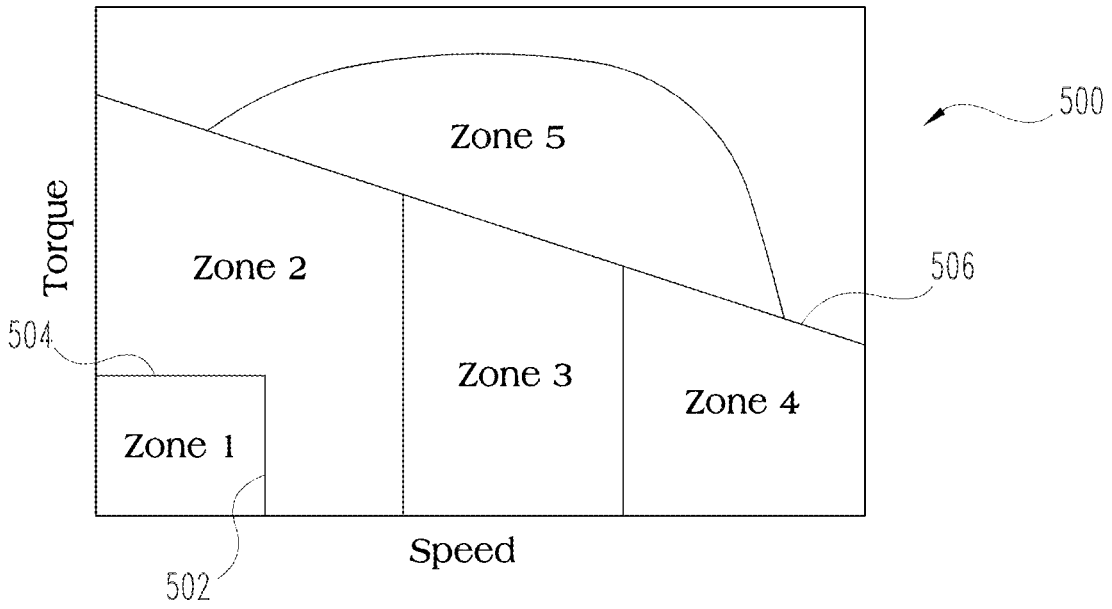
FIG. 5 is an engine load-speed map showing fluid flow control to the piston cooling nozzles under various engine operating conditions, according to an embodiment of the present disclosure.

For example, referring to FIG. 5, there is shown engine operating parameters for determining PCN ON and PCN OFF conditions. FIG. 5 includes a speed-torque map 500 with various operating zones defined by an engine speed operating parameters and an engine torque operating parameter. Operating zone 1 is defined by a low engine speed threshold 502 and a low engine torque threshold 504. In response to engine operating parameters (engine speed and engine torque) in zone 1, PCN(s) 118 is controlled to be continuously OFF while in zone 1.

FIG. 5 also defines an operating zone 5 that lies above an engine speed-torque boundary 506. In response to engine speed and engine torque in zone 5, PCN(s) 118 is controlled to be ON continuously while in zone 5. One or more intermediate zones 2, 3, 4 are located between zone 1 and zone 5. In response to an engine speed operating parameter and an engine torque operating parameter in these intermediate zones, PCN(s) 118 is controlled to be ON for a calibratable period of time and then OFF for a calibratable period of time. In the transient operating condition, transition time from high speed high torque zone to low speed low torque zone is controlled by mean of calibratable soft timers to allow cylinders to cool down before PCN is OFF.

Figure 6:
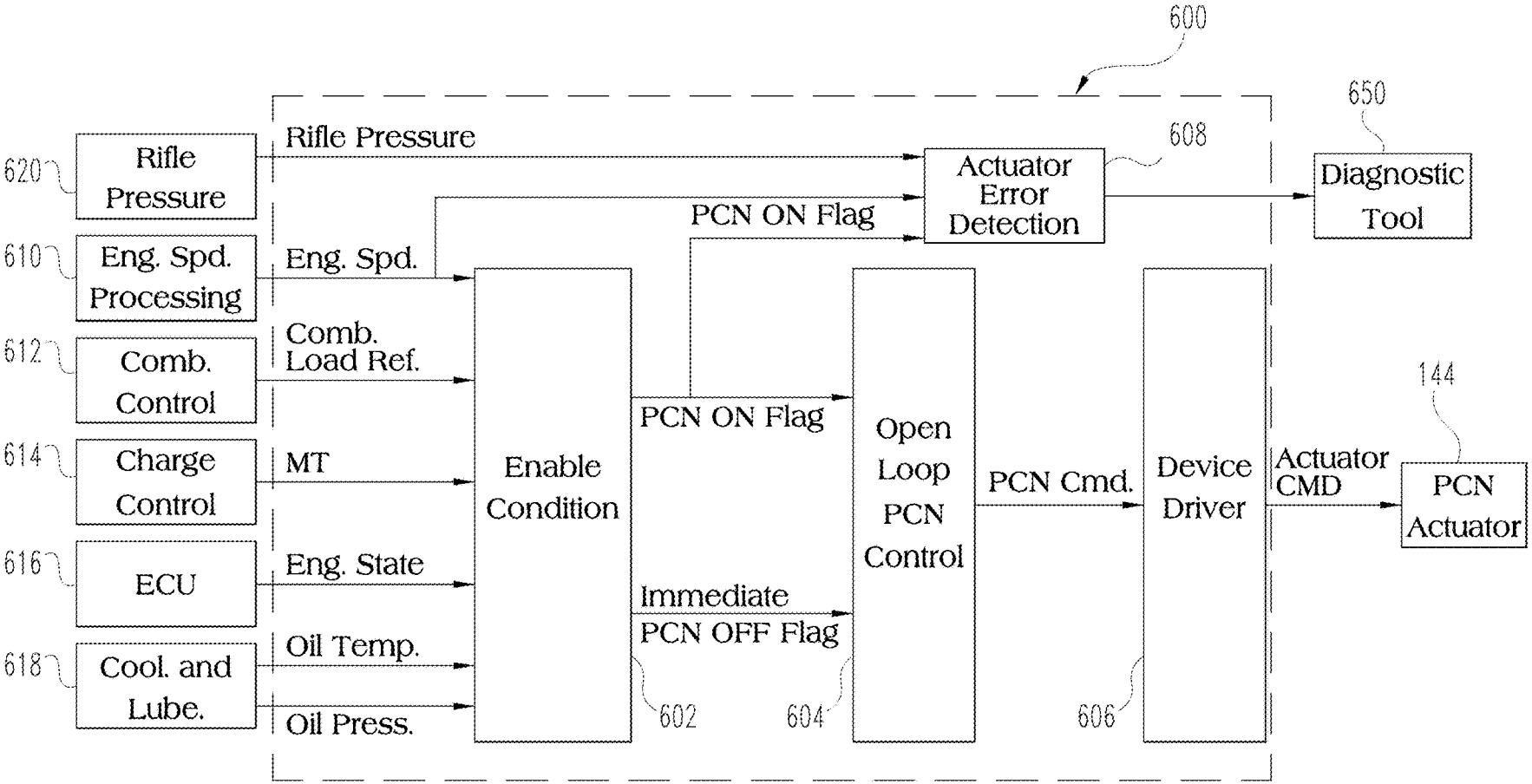
FIG. 6 is a schematic diagram of a controller configured to control fluid flow to piston cooling nozzles according to an embodiment of the present disclosure.

Referring to FIG. 6, an embodiment for a control apparatus 600 for performing procedure 400 is shown. Control apparatus 600 may be ECU 140, a part of ECU 140, and/or some other part of the ECS in communication with ECU 140. Control apparatus 600 includes an enable condition determination circuit 602, an open loop PCN control circuit 604, and a device driver circuit 606. Control apparatus 600 also includes an actuator error detection circuit 608.

Figure 7:
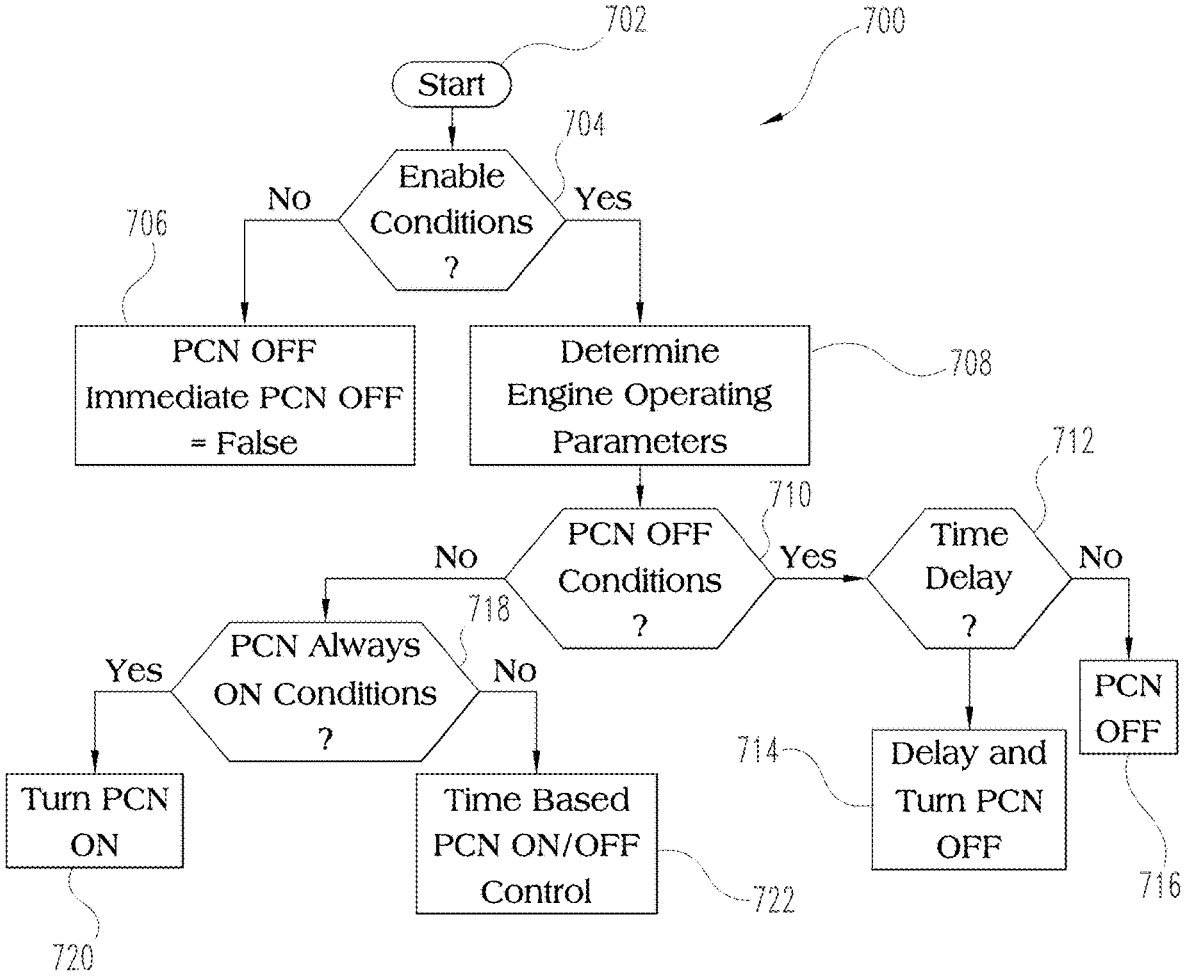
FIG. 7 is a flow diagram of a procedure for controlling fluid flow to piston cooling nozzles with the controller of FIG. 6 according to an embodiment of the present disclosure.

Enable condition determination circuit 602 of control apparatus 600 receives an engine speed input from an engine speed processing unit 610, a combustion load reference from combustion control unit 612, an intake manifold temperature input from charge control unit 614, engine state input from an ECU 616, and oil temperature and oil pressure inputs from coolant and lubrication unit 618. Enable condition determination circuit 602 processes these inputs and outputs a PCN ON flag or an immediate PCN OFF flag to open loop PCN control circuit 604. An example procedure that can be performed by enable condition determination unit 602 is shown in FIG. 7 and discussed further below.

Actuator error detection circuit 608 of control apparatus 600 receives a PCN rifle pressure input from PCN rifle pressure sensor 146, an engine speed input from engine speed processing unit 610, and a PCN ON flag from enable condition determination circuit 602. Actuator error detection circuit 608 can compare actual rifle pressure with an estimated rifle pressure that is estimated based on engine speed. If the sensed rifle pressure value is greater than the estimated rifle pressure value, an error flag is set if the difference is greater than a tolerance limit for a calibratable period of time. Actuator error detection circuit 608 is configured to output the actuator error flag to a diagnostic tool 650, which can develop engine protection logic to protect against actuator 144 failure or malfunction.

Open loop PCN control circuit 604 is configured to determine a PCN command that is output to device drive circuit 506. When the PCN ON flag is true and input to PCN control circuit 604, the duty cycle for actuator 144 of fluid flow control device 114 is set by the PCN command to fully open fluid flow control device 114 and the PCN rifle 116 to PCN(s) 118. When the PCN ON flag is false and input to PCN control circuit 604, the duty cycle for actuator 144 of fluid flow control device 114 is set by the PCN command to fully close fluid flow control device 114 to close the PCN rifle 116 to PCN(s) 118.

When the PCN IMMEDIATE OFF flag is true, the PCN can be turned off immediately, the duty cycle for actuator 144 of fluid flow control device 114 is set by PCN command to fully close the fluid flow control device 114 to close PCN rifle 116 and PCN(s) 118 with no delay. When the PCN IMMEDIATE OFF flag is false, the PCN ON flag is true, and the engine operating parameters are in one or more zones in which time-based, intermittent operation of PCN(s) 118 is permitted, the duty cycle for actuator 144 is set to fully open for a calibratable period of time then set to fully close for a calibratable period of time. If the engine operating zone changes, PCN ON/OFF control is based on the current zone of operation, unless the engine operating zone is one that permits immediate PCN OFF for the PCN(s) 118, such as zone 1.

Device driver circuit 606 receives the PCN command from open loop PCN control circuit 604, and outputs an actuator command to PCN actuator 144. The PCN actuator 144 then moves valve 212 of fluid flow control device 114 to the open position if the PCN command is PCN 118 ON, and to the closed position if the PCN command is PCN 118 OFF.

Referring to FIG. 7, an embodiment of a procedure 700 for controlling fluid flow control device 114 to open or close PCN rifle 116 to turn PCN 118 ON or OFF is illustrated. Procedure 700 starts at 702, and continues at conditional 704 to determine if enable conditions are met for PCN 118 ON/OFF control. If conditional 704 is NO, procedure 700 continues at operation 706 where fluid flow control device 114 is set to the closed position to turn PCN 118 OFF, and the PCN IMMEDIATE OFF flag is set to false. If conditional 704 is YES, then procedure 700 continues at operation 708 to evaluate engine operating parameters to determine which of zones 1-5 (FIG. 5) to employ for PCN 118 ON/OFF control. In an embodiment, procedure 700 has dithering with tunable threshold to prevent frequent transitioning between PCN ON and PCN OFF.

From operation 708, procedure 700 continues at conditional 710 to determine if the engine operating parameters indicate the PCN(s) 118 can be turned OFF, such as by lying in zone 1. If conditional 710 is YES, procedure 700 continues at conditional 712 to determine if a time delay is required before closing fluid flow control device 114 to turn PCN 118 OFF. For example, if the engine operating parameters move from zone 5 (always ON) to zone 1, then the PCN IMMEDIATE OFF flag is set to FALSE, and a time delay can be imposed before turning PCN 118 OFF to allow for additional cooling of the piston and piston components which have just been operating in zone 5. Therefore, if conditional 712 is YES, procedure 700 continues at operation 714 to impose a time delay before closing the fluid flow control device 114 to turn the PCN 118 OFF. If conditional 714 is NO, and the PCN IMMEDIATE OFF flag is set to TRUE, then fluid flow control device 114 can be closed to turn PCN 118 OFF immediately. In addition, any timers for PCN ON and PCN OFF can be reset.

If conditional 712 is NO, procedure 700 continues at conditional 718 to determine if engine operating conditions indicate a PCN always ON condition is met, such as the engine operating parameters lying in zone 5 of FIG. 5. If conditional 718 is YES, then procedure 700 continues at operation 720 to move fluid flow control device to the open position and turn PCN 118 ON. Any times for PCN ON and PCN OFF can be reset, and the immediate PCN OFF flag is set to FALSE so that a time delay is imposed before turning PCN 118 OFF when transitioning out of zone 5.

If conditional 718 is NO, procedure 700 continues at operation 722 to employ time-based PCN ON/OFF control. In an embodiment, the engine operating parameters are used to identify one of the multiple zones 2-4 of FIG. 5 which have different time characteristics for time-based ON/OFF control of PCN(s) 118.

Figure 8:
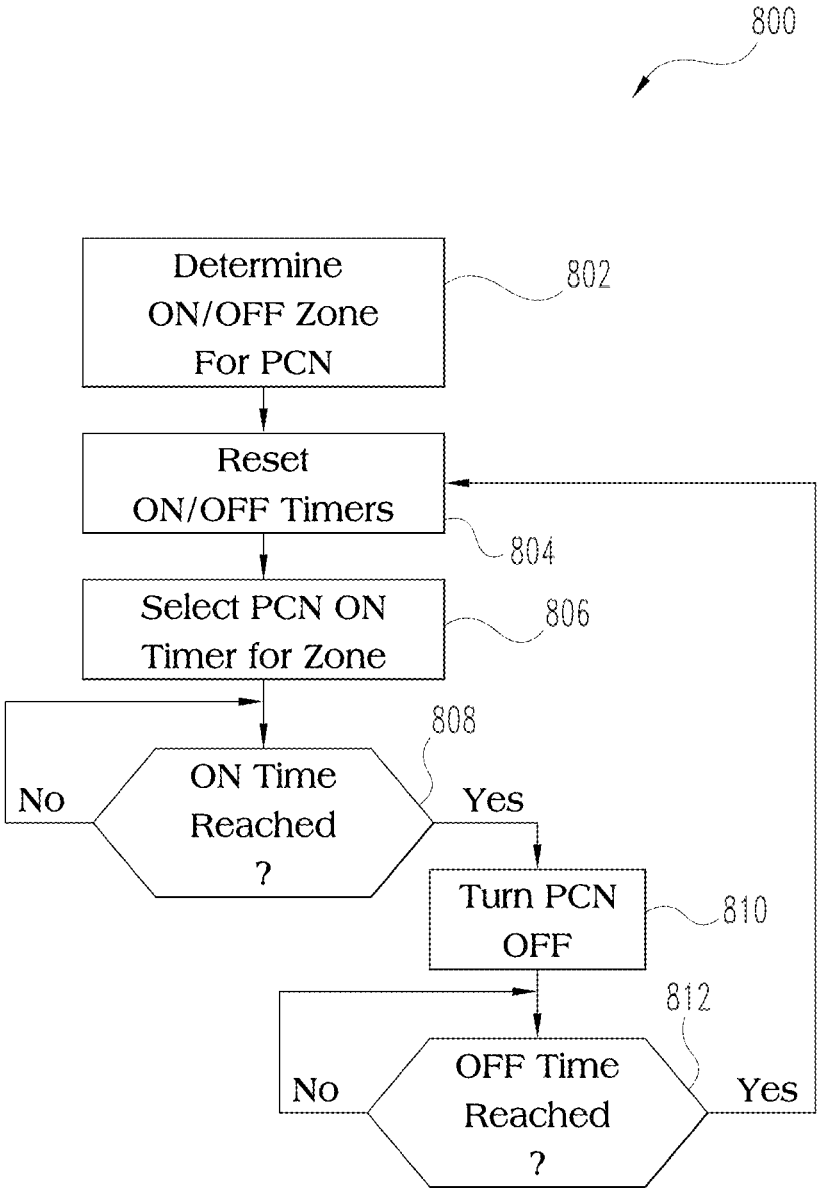
FIG. 8 is a flow diagram of a procedure for controlling fluid flow to piston cooling nozzles with the controller of FIG. 6 according to an embodiment of the present disclosure.

For example, referring to FIG. 8, a procedure 800 is shown for an embodiment in which engine operating parameters can be classified in zones 2-4 for PCN time-based ON/OFF control. Procedure 800 includes an operation 802 to determine the ON/OFF zone based on the engine operating parameters, such as the engine speed operating parameter and engine torque operating parameter. Once the zone is determined based on the engine operating parameters, procedure 800 includes an operation 804 to reset a PCN ON timer and a PCN OFF timer. Procedure 800 continues at operation 806 to select the PCN ON time for the determined operating zone. Fluid flow control device 114 can be opened to turn the PCN 118 ON.

At conditional 808, procedure 800 determines if the PCN ON time for the current zone is reached. If conditional 808 is NO, procedure 800 continues to operate with the PCN 118 ON. If conditional 808 is YES, then procedure 800 continues at operation 810 to close the fluid flow control device 114 to turn the PCN 118 OFF. Procedure 800 then continues at conditional 812 to determine if the PCN OFF time for the zone has been reached. If conditional 812 is NO, procedure 800 continues with the PCN 118 OFF. If conditional 812 is YES, procedure 800 returns to operation 804 to reset the PCN ON and PCN OFF timers.

In an embodiment, for engine operating parameters in zone 2, PCN(s) 118 is turned ON for a first calibratable amount of time and then turned OFF for a different second calibratable amount of time. While the engine operating parameters are in zone 2, this time-based PCN ON/OFF strategy will be active. For engine operating parameters in zone 3, PCN(s) 118 is turned ON for a third calibratable amount of time and turned OFF for a fourth calibratable amount of time. While the engine operating parameters are in zone 3, this second time-based PCN ON/OFF strategy will be active. While the engine operating parameters are in zone 4, PCN(s) 188 is ON for a fifth calibratable amount of time and turned OFF for a sixth calibratable amount of time. While the engine operating parameters are in zone 4, this third time-based PCN ON/OFF strategy will be active.

In an embodiment, the time based ON/OFF control for zones 2-4 provides increasing PCN ON time and decreasing PCN OFF time over a predetermined period of time as the engine operating parameters moved from zone 2 to zone 4. For example, in a specific embodiment, in zone 2 the PCN ON time can be 4 minutes followed by a PCN OFF time of 11 minutes over a 15 minute time period. In zone 3, the PCN ON time can be 8 minutes followed by a PCN OFF time of 7 minutes over a 15 minute period. In zone 4, the PCN on time can be 12 minutes followed by a PCN OFF time of 3 minutes over a 15 minute time period. When engine operating parameters transition between zones, the PCN ON/OFF control follows the currently active zone logic with no time delay, unless the transition is from zone 5 to zone 1.

In an embodiment, the present disclosure contemplates that no time-based ON/OFF zones are provided between zones 1 and 5 to control operation of fluid flow control device 114 and PCN(s) 118 in a time-based ON/OFF mode. In an embodiment, only one or two time-based ON/OFF zones are employed between zones 1 and 5 to control operation of fluid flow control device 114 and PCN(s) 118 in a time-based ON/OFF mode. In an embodiment, more than three time-based ON/OFF zones are employed between zones 1 and 5 to control operation of fluid flow control device 114 and PCN(s) 118 in a time-based ON/OFF mode.

Further written description of a number of aspects of the present disclosure shall now be provided. One aspect includes a piston cooling system for an internal combustion engine. The piston cooling system includes a reservoir from which fluid is fed and at least one PCN coupled to the reservoir. The PCN is configured to direct the fluid fed from the reservoir for spraying the fluid onto a piston in the engine. The piston cooling system also includes a fluid flow control device connecting the reservoir and the PCN. The fluid flow control device includes a chamber fluidly connecting the reservoir to the PCN and a valve movably received in the chamber. The valve is electronically controllable to move between a first position that allows fluid to flow through the chamber to the PCN and a second position that prevents fluid from flowing through the chamber to the PCN.

In an embodiment, the system includes an electronic control unit operably connected to the valve. The electronic control unit is configured to control the valve in response to one or more operating parameters of the internal combustion engine.

In a further embodiment, the electronic control unit is configured to move or maintain the valve to the second position in a PCN off mode of operation in response to an engine speed operating parameter being less than a low engine speed threshold and an engine torque operating parameter being less than a low engine torque threshold.

In yet a further embodiment, the electronic control unit is configured to move the valve from the second position to the first position in response to at least one of the engine speed operating parameter being greater than the low engine speed threshold and the engine torque operating parameter being greater than the low engine torque threshold.

In yet a further embodiment, the electronic control unit is configured to maintain the valve in the first position in a PCN on mode of operation in response to the engine speed and the engine torque lying above an engine speed-torque boundary.

In yet a further embodiment, the electronic control unit is configured to control the valve to move between the first position and the second position in a time-based PCN ON/OFF mode of operation in response to the engine speed and the engine torque lying below the speed-torque boundary, the engine speed operating parameter being greater than the low engine speed threshold, and the engine torque operating parameter being greater than the low engine torque threshold.

In yet a further embodiment, in the time-based PCN ON/OFF mode of operation, the electronic control unit is configured to maintain the valve in the first position and the second position for predetermined amounts of time based on the engine speed operating parameter and the engine torque operating parameter.

In a further embodiment, the electronic control unit is configured to maintain the valve in the first position for a predetermined period of time in response to the engine speed operating parameter and the engine torque operating parameter decreasing above the speed-torque boundary to the engine speed operating parameter being less than the low engine speed threshold and the engine torque operating parameter being less than the low engine torque threshold.

In an embodiment, the chamber of the fluid flow control device fluidly connects a main oil rifle of the internal combustion engine to a PCN rifle of the internal combustion engine.

According to another aspect of the disclosure, a method for controlling fluid flow to a PCN of an internal combustion engine is provided. The method includes determining one or more operating parameters of the internal combustion engine; determining an open position or a closed position for a valve in a fluid flow control device in response to the one or more operating parameters, the fluid flow control device connecting a PCN rifle of the internal combustion engine to a fluid source; and controlling the valve to either remain in, or move to, the open position or the closed position in response to a current position of the valve and the determined open position or closed position for the valve.

In an embodiment, the one or more operating parameters include an engine speed and an engine torque.

In an embodiment, the method includes enabling or inhibiting PCN operation based on one or more of an engine state, oil temperature, oil pressure, coolant temperature, and intake manifold temperature.

In an embodiment, the method includes determining the closed position for the valve in response to an engine speed operating parameter being less than a low engine speed threshold and an engine torque operating parameter being less than a low engine torque threshold.

In a further embodiment, the method includes determining the open position for the valve in response to at least one of the engine speed operating parameter being greater than the low engine speed threshold and the engine torque operating parameter being greater than the low engine torque threshold.

In yet a further embodiment, the method includes maintaining the valve in the open position in response to the engine speed operating parameter and the engine torque operating parameter lying above a speed-torque boundary.

In yet a further embodiment, the method includes intermittently opening and closing the valve in response to the engine speed operating parameter and engine torque operating parameter lying below the speed-torque boundary and being greater than at least one of the low engine speed threshold and the low engine torque threshold.

In yet a further embodiment, intermittently opening and closing the valve includes increasing an amount of time the valve is open versus the amount of time the valve is closed as the engine speed increases.

According to another aspect of the disclosure, an apparatus for controlling fluid flow to a PCN of an internal combustion engine is provided. The apparatus includes an electronic controller configured to receive one or more operating parameters from the internal combustion engine and provide one or more commands to a fluid flow control device that controls fluid flow to the PCN. The electronic controller is further configured to determine an open position or a closed position for a valve in the fluid flow control device in response to the one or more operating parameters, and control the valve to either remain in or move to the open position or the closed position in response to a current position of the valve and the determined open position or closed position for the valve.

In an embodiment, the one or more operating parameters include an engine speed operating parameter and an engine torque operating parameter. In a further embodiment, the open position or the closed position is determined in response to a zone on an engine speed-torque speed map that corresponds to the engine speed operating parameter and the engine torque operating parameter.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A piston cooling system for an internal combustion engine, comprising: a reservoir from which fluid is fed; at least one piston cooling nozzle (PCN) coupled to the reservoir, the PCN configured to direct the fluid fed from the reservoir for spraying the fluid onto a piston in the engine; and a fluid flow control device connecting the reservoir and the PCN, the fluid flow control device including: a chamber fluidly connecting the reservoir to the PCN; and a valve movably received in the chamber, wherein the valve is electronically controllable to move between a first position that allows fluid to flow through the chamber to the PCN and a second position that prevents fluid from flowing through the chamber to the PCN; and an electronic control unit operably connected to the valve, the electronic control unit configured to control the valve in response to one or more operating parameters of the internal combustion engine, wherein the electronic control unit is configured to control the valve to move between the first position and the second position in a time-based intermittent PCN on and off mode of operation while the one or more operating parameters of the internal combustion engine are in one or more intermediate zones that are above at least one of an engine speed threshold and an engine torque threshold and that are below an engine speed-torque boundary, and wherein while in the one or more intermediate zones the time-based intermittent PCN on and off mode operation includes controlling the valve to be in the first position for a calibratable period of time and then in the second position for another calibratable period of time.

2. The system of claim 1, wherein the electronic control unit is configured to move or maintain the valve to the second position in a PCN off mode of operation in response to an engine speed operating parameter being less than the engine speed threshold and an engine torque operating parameter being less than the engine torque threshold.

3. The system of claim 2, wherein the electronic control unit is configured to move the valve from the second position to the first position in response to at least one of the engine speed operating parameter being greater than the engine speed threshold and the engine torque operating parameter being greater than the engine torque threshold.

4. The system of claim 3, wherein the electronic control unit is configured to maintain the valve in the first position in a PCN on mode of operation in response to the engine speed and the engine torque lying above the engine speed-torque boundary.

5. The system of claim 4, wherein the electronic control unit is configured to control the valve to move between the first position and the second position in the time-based intermittent PCN on and off mode of operation in response to the engine speed and the engine torque lying below the speed-torque boundary, the engine speed operating parameter being greater than the engine speed threshold, and the engine torque operating parameter being greater than the engine torque threshold.

6. The system of claim 1, wherein the one or more intermediate zones include a plurality of intermediate zones and in the time-based intermittent PCN on and off mode of operation the electronic control unit is configured to maintain the valve in the first position and the second position for calibratable periods of time that vary depending on which of the plurality of intermediate zones the one or more engine operating parameters is in.

7. The system of claim 4, wherein the electronic control unit is configured to maintain the valve in the first position for a predetermined period of time in response to the engine speed operating parameter and the engine torque operating parameter decreasing above the speed-torque boundary to the engine speed operating parameter being less than the low engine speed threshold and the engine torque operating parameter being less than the low engine torque threshold.

8. The system of claim 1, wherein the chamber of the fluid flow control device fluidly connects a main oil rifle of the internal combustion engine to a PCN rifle of the internal combustion engine.

9. A method for controlling fluid flow to a piston cooling nozzle (PCN) of an internal combustion engine, the method comprising: determining one or more operating parameters of the internal combustion engine; determining an open position or a closed position for a valve in a fluid flow control device in response to the one or more operating parameters, the fluid flow control device connecting a PCN rifle of the internal combustion engine to a fluid source; and controlling the valve to either remain in, or move to, the open position or the closed position in response to a current position of the valve and the determined open position or closed position for the valve, wherein the controlling further includes controlling the valve to move between the open position and the closed position in a time-based intermittent PCN on and off mode of operation while the one or more operating parameters of the internal combustion engine are in one or more intermediate zones that are above at least one of an engine speed threshold and an engine torque threshold and that are below an engine speed-torque boundary, and wherein while in the one or more intermediate zones the time-based intermittent PCN on and off mode operation includes controlling the valve to be in the open position for a calibratable period of time and then in the closed position for another calibratable period of time.

10. The method of claim 9, wherein the one or more operating parameters include an engine speed and an engine torque.

11. The method of claim 9, further comprising enabling or inhibiting PCN operation based on one or more of an engine state, oil temperature, oil pressure, coolant temperature, and intake manifold temperature.

12. The method of claim 9, further comprising determining the closed position for the valve in response to an engine speed operating parameter being less than the engine speed threshold and an engine torque operating parameter being less than the engine torque threshold.

13. The method of claim 12, further comprising determining the open position for the valve in response to at least one of the engine speed operating parameter being greater than the engine speed threshold and the engine torque operating parameter being greater than the engine torque threshold.

14. The method of claim 13, further comprising maintaining the valve in the open position in response to the engine speed operating parameter and the engine torque operating parameter lying above the speed-torque boundary.

15. The method of claim 9, wherein the one or more intermediate zones include a plurality of intermediate zones and in the time-based intermittent PCN on and off mode of operation the electronic control unit is configured to maintain the valve in the open position and the closed position for calibratable periods of time that vary depending on which of the plurality of intermediate zones the one or more engine operating parameters is in.

16. The method of claim 15, wherein intermittently opening and closing the valve includes increasing an amount of time the valve is open versus the amount of time the valve is closed as the engine speed increases.

17. An apparatus for controlling fluid flow to a piston cooling nozzle (PCN) of an internal combustion engine, the apparatus including: an electronic controller configured to receive one or more operating parameters from the internal combustion engine and provide one or more commands to a fluid flow control device that controls fluid flow to the PCN, the electronic controller further configured to: determine an open position or a closed position for a valve in the fluid flow control device in response to the one or more operating parameters; and control the valve to either remain in or move to the open position or the closed position in response to a current position of the valve and the determined open position or closed position for the valve; and control the valve to move between the open position and the closed position in a time-based intermittent PCN on and off mode of operation while the one or more operating parameters of the internal combustion engine are in one or more intermediate zones that are above at least one of an engine speed threshold and an engine torque threshold and that are below an engine speed-torque boundary, and wherein while in the one or more intermediate zones the time-based intermittent PCN on and off mode operation includes controlling the valve to be in the open position for a calibratable period of time and then in the closed position for another calibratable period of time.

18. The apparatus of claim 17, wherein the one or more operating parameters include an engine speed operating parameter and an engine torque operating parameter.

19. The apparatus of claim 18, wherein the open position or the closed position is determined in response to a zone on an engine speed-torque speed map that corresponds to the engine speed operating parameter and the engine torque operating parameter.

20. The system of claim 1, wherein the calibratable periods of time the PCN is on and off in the time-based intermittent PCN on and off mode vary depending on a speed and torque for the internal combustion engine.

* * * * *